US006235687B1

(12) United States Patent
Nadasdi et al.

(10) Patent No.: US 6,235,687 B1
(45) Date of Patent: May 22, 2001

(54) METHOD FOR PRODUCING LUBRICATION OILS POSSESSING ANTI RUST PROPERTIES CONTAINING ACIDIC ANTI RUST ADDITIVE AND ACID SCAVENGERS

(75) Inventors: Todd Timothy Nadasdi; William Nelson Hayter, both of Sarnia (CA)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/399,651

(22) Filed: Sep. 21, 1999

Related U.S. Application Data

(63) Continuation-in-part of application No. 09/169,650, filed on Oct. 9, 1998, now abandoned.

(51) Int. Cl.[7] ..... C10M 129/00; C10M 133/00; C10M 133/16

(52) U.S. Cl. ..... 508/304; 508/545; 508/551; 508/556; 508/561; 508/579; 508/580

(58) Field of Search ..... 508/551, 561, 508/579, 545, 580, 556, 304

(56) References Cited

U.S. PATENT DOCUMENTS

| | | | |
|---|---|---|---|
| 3,346,496 | 10/1967 | Neumann et al. | 252/50 |
| 5,498,356 | 3/1996 | Kamakura et al. | 252/50 |
| 5,614,483 | 3/1997 | Fessenbecker et al. | 508/550 |
| 5,806,336 | 9/1998 | Sunaga et al. | 62/469 |

FOREIGN PATENT DOCUMENTS

| | | | |
|---|---|---|---|
| 0715079 | 6/1996 | (EP) | C10M/107/00 |

OTHER PUBLICATIONS

Ciba, "Lubricant Additives", Key Products Selection Guide (undated).

King Industries, "K–CORR®, Environmentally Friendly Rust & Corrosion Inhibitors" (undated).

King Industries, "NA–SUL® News", Feb. 1987, pp. 1 and 6.

RheinChemie, "Additin® RC 4801", Corrosion Inhibitor (specification sheet), Nov. 1994.

"A New Additive for the Hydrolytic and Oxidative Stabilization of Ester based Lubricants and Greases", Roehrs & Fessenbecker, NLGI Spokesman, vol. 61, No. 3, pp. 10–16, Jun. 1997.

*Primary Examiner*—Margaret Medley
*Assistant Examiner*—Cephia D. Toomer
(74) *Attorney, Agent, or Firm*—Joseph J. Allocca

(57) ABSTRACT

Lubricating oils exhibiting anti rust properties are obtained by adding to the lubricating oil an acidic anti rust additive and an acid scavenger such as carbodiimide, in a specific sequence.

4 Claims, No Drawings

METHOD FOR PRODUCING LUBRICATION OILS POSSESSING ANTI RUST PROPERTIES CONTAINING ACIDIC ANTI RUST ADDITIVE AND ACID SCAVENGERS

This application is a Continuation-in-Part of U.S. Ser. No. 09/169,650 filed Oct. 9, 1998, now abandoned.

BACKGROUND OF THE INVENTION

1. Field of the Invention

The present invention relates to lubricating oils and to a method for providing anti rust properties to such oils by using a combination of additives.

2. Description of the Present Invention

It has been discovered that a lubricating oil possessing anti-rust properties can be prepared when using an acidic anti rust additive and an acid scavenger by employing a specific sequence of additive addition.

The lubricating oil contains a major portion of base oil. Base oils typically comprise mineral oils, preferably those mineral oils of high saturates content such as hydrotreated oils and white oils, and synthetic oils such as PAO and esters.

Examples of acid scavengers useful in the present invention are one or more mono or poly carbodiimide, glycidylether or epoxide, alkanol amines and arylamines. Useful mono carbodiimides include materials of the formula $$R_1—(N{=}C{=}N)—R_2$$

wherein $R_1$ and $R_2$ are the same or different and are hydrogen, hydrocarbyl groups or nitrogen and/or oxygen containing hydrocarbyl groups. Thus $R_1$ and $R_2$ can be $C_1$–$C_{12}$ aliphatic groups, $C_6$–$C_{18}$ aromatic groups or aromatic-aliphatic groups.

Thus, $R_1$ and $R_2$ may be for example hydrogen atom, alkyl groups such as methyl ethyl, propyl isopropyl, butyl, isobutyl, pentyl, 2-methylbutyl, hexyl, heptyl, octyl, 2-ethylhexyl, nonyl, decyl, undecyl, dodecyl and the like, alkenyl groups such as propenyl, butenyl, isobutenyl, pentenyl, 2-ethylhexenyl octenyl and the like, cycloalkyl groups such as cyclopentyl, cyclohexyl methylcyclopentyl, ethylcyclopentyl and the like, aryl groups such as phenyl, naphtyl and the like, alkyl substituted aryl groups such as alkyl substituted phenyl groups for example toluyl, isopropylphenyl, diisopropylphenyl, triisopropylphenyl nonylphennyl and the like, aralkyl groups such as benzyl, phenetyl and the like. Examples of monocarbodiimides are the following: di-isopropyl-carbodiimide, di-n-butyl-carbodiimide, methyl-tert-butyl-carbodiimide, dicyclohexyl-carbodiimide, diphenyl-carbodiimide, di-p-tolyl-carbodiimide and 4,4'-didodecyl-diphenyl-carbodiimide. Of special advantage are diphenyl-monocarbodiimides which carry on the phenyl moiety at the ortho-position to the carbodiimide group various substituent groups, e.g., alkyl, alkoxy, aryl and araLkyl radicals, such as 2,2'-diethyl-di-phenyl-carbodiimide, 2,2'-di-isopropyl-diphenyl-carbodiimide, 2,2'-diethoxy-diphenyl-carbodiimide, 2,6,2',6'-tetra-ethyl-diphenyl-carbodiimide, 2,6,2',6'-tetraisopropyl-di-phenyl-carbodiimide, 2,6,2',6'-tetraethyl-3,3'-dichloro-di-phenyl-carbodiimide, 2,2'-diethyl-6,6'-dichloro-diphenyl-carbodiimide, 2,6,2',6'-tetra-isobutyl-3,3'-dinitro-diphenyl-carbodiimide and 2,4,6,2',4',6'-hexaisopropyl-diphenyl-carbodiimide.

Suitable polycarbodiimides are, for example, tetramethylene-ω,ω'- bis-(tert-butyl-carbodiimide), hexamethylene-ω,ω'-bis-(tert-butyl-carbodiimide), tetramethylene-ω,ω'-bis-(phenyl-carbodiimide) and those compounds which may be obtained by heating aromatic polyisocyanates such as 1,3-di-isopropyl-phenylene-2,4-di-iso-cyanate, 1-methyl-3,5-diethyl-phenylene-2,4-diisocyanate and 3,5,3',5'-tetra-isopropyl-diphenylmethane4,4-di-isocyanate, in the presence of tertiary amines, basically reacting metal compounds, carboxylic acid metal salts or non-basic organometal compounds at a temperature of at least 120° C., according to the process of German Patent No. 1,156,401.

Glycidylether acid scavengers are of the general formula:

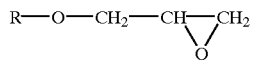

wherein R is hydrocarbon.

Epoxides can be cyclic, acyclic, and polymeric in nature. Cyclic epoxides include the mono- and bis-cyclohexene oxides, monoepoxyethylene cyclohexanes. Acyclic epoxides include epoxidized vegetable oils, epoxidized ester (e.g., ethyl-cis-9,10-epoxy stearate and glycidyl stearate), and the aforementioned glycidyl ethers. Polyepoxy novalacs, polyglycidyl ethers, polyepoxy-cyclohexanes, and polyepoxy esters are examples of polymeric epoxides. Typical useful epoxides are the cycloaliphatic epoxides generally of the formula:

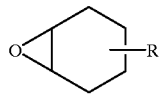

where R is a hydrocarbyl group which may contain functional groups such as esters, ethers, ketones, aldehydes, additional epoxy groups, amines, amides, imides, thiolates, etc. Other useful epoxides include epoxides exemplified by:

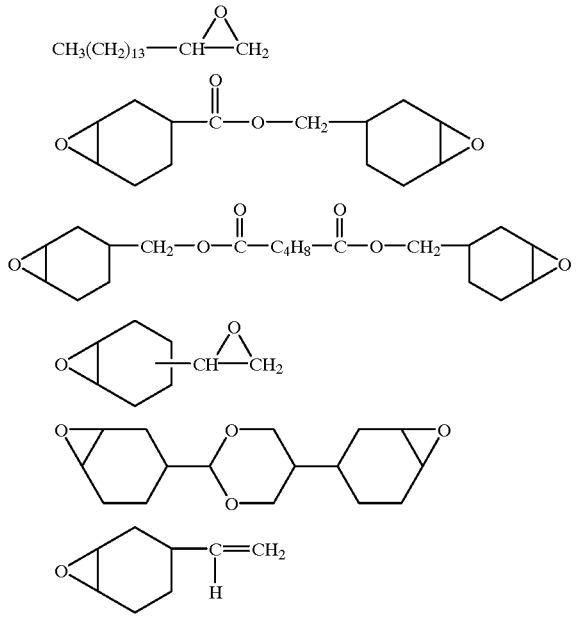

Carbodiimide, glycidylether and epoxide acid scavengers are materials well known in the literature and the terms will be used herein without further definition.

Alkanol amines include

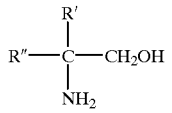

wherein R' and R" are the same or different and are selected from hydrogen, $C_1$–$C_{10}$ alkyl groups, more preferably $C_1$–$C_3$ alkyl groups.

Other suitable alkanol amines include

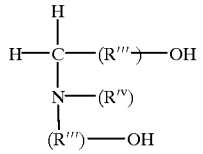

wherein R'", in each instance, is independently selected from $C_1$–$C_{10}$ hydrocarbyl, preferably $C_1$–$C_{10}$ alkyl, more preferably $C_1$–$C_3$ alkyl, and $R'^{v}$ is selected from hydrogen or the group (R'")—OH where R'" is as previously defined.

Alkoxylated tertiary amities are also suitable such as the methoxylated tertiary amines, ethoxylated tertiary amine, propoxylated tertiary amines. Arylamines such as P-Toluidine, p-phenylene diamine can also be used as acid scavengers as can N,N,N',N' tetraalkyl 1,8 naphthylene diamine.

The anti rust additive used on the present invention is any acidic anti rust additive such as carboxylic acid or carboxylic acid producing compounds. Thus, included in the description of acidic anti rust additives are carboxylic acids and carboxylic acid producing compounds such as their salts, amides, imides, anhydrides, acid halogenides, esters, and also carbamic acids or carbamic acid producing compounds such as carbamides and carbamates, and also oxo acids and salts of oxo acids of sulfur or phosphorous or compounds which produce such oxo acids. Non-limiting examples of such oxo acids include sulphinic acid, sulphonic acid, sulphonamides, sulphuric acid, sulphurous acid, thiosulfuc acid, disulfuric acid, dithionoic acid, polythionic acid, phosphinic acid, phosphonic acid, phosphoric acid. The effectiveness of these rust inhibitors is related to the affinity of the acid functionality for the metal surface.

As would be readily apparent, the presence of acid scavengers in a formulation containing acid based anti rust additives would be expected to have a negative impact on the effectiveness of the acidic anti-rust additive.

It has been discovered, however, that the anti rust properties of a lubricating oil containing acidic anti rust additives and acid scavengers can be preserved by employing a specific blending procedure in the production of the lube oil formulation.

Specifically, anti rust properties are preserved when the acid scavenger is added to the formulated oil before the acidic anti rust additive is added and the resulting mixture containing the acid scavenger and acidic anti-rust additive is not subjected to any direct heating. Thus, in preparing a formulated oil, all other additives are added to the base oil first, with any necessary heating being employed to effect solubilization. Direct heating is then stopped and the acid scavenger is then added to the formulation and the acidic anti rust additive is subsequently added with no additional direct heating. Additional direct heating is to be avoided so as to avoid local surface hot spots at which reaction between the acid scavenger and the acidic anti rust agent would occur. Preferably the oil is permitted to cool or is held at a bulk oil temperature of about 15 to 100° C., preferably about 40° C. to 85° C., most preferably about 45° C. to 60° C. Formulations prepared using the recited sequential addition procedure were found to pass the ASTM D665B rust test. The ASTM D665B rust test procedure consists of placing a metal pin in a beaker which contains the lube oil formulation to be evaluated and synthetic sea water with stirring at 60° C. After 24 hours the pin is evaluated for visual rust spots. The test is considered a pass if no visible rust is present.

The base lubricating oils which may be advantageously treated using the combination is any natural or synthetic oil of lubricating viscosity.

Typical natural oils include paraffinic and naphthenic mineral oils, vegetable oils and especially hydrotreated oils.

Synthetic oils include polyalpha olefins and ester oils, especially polyol ester oils made by reacting polyhydric alcohols such as those containing 2–6 hydroxyl group with acids such as mono or di carboxylic acids containing for example 2–40 carbon atoms, preferably mono carboxylic acids containing 16–36 carbon atoms such as oleic and dioleci acid. Typical polyhydric alcohols include trimethylol propane, penta erythritol. Other useful esters include those disclosed in U.S. Pat. No. 5,658,863, 5,681,800, 5,767,047, and 4,826,633.

In the practice of the present invention the lubricating oil formulation preferably contains from about 0.01 to 5 wt % carbodiimide acid scavenger, preferably about 0.05 to 0.5 wt %/o carbodiimide acid scavenger or about 0.1 to 25 wt % epoxide or glycidyl ether acid scavenger, preferably 1 to 10 wt % epoxide or glycidyl ether acid scavenger, and about 0.01 to 2 wt % acidic anti rust additive, preferably about 0.01 to 0.5 wt % acidic anti rust additive.

The lubricating oils prepared by the sequence addition procedure of the present invention may also contain any of the other commonly used lubricating oil additives. Thus, the formulated oils can contain additional anti oxidants such as phenol and amine type anti oxidants, viscosity and viscosity index improvers such as polyalkylene or polyolefin viscosity improver, e.g., polyisobutylene, poly(meth)acrylate viscosity index improvers metal deactivator such as triazoles and thiadiazoles, extreme pressure and anti wear additives such as phosphate esters, amine phosphates, sulfurized olefins, other sulfurized and polysulfurized hydrocarbons, metal thio phosphates such as ZDDP, metal thio carbamates, other anti rust agents, dispersants such as succinimides, detergents such as metal sulfonates, phenates or carboxylates, anti foamants, etc. The amount of such other additives included in the formulation will be the amount typically and traditionally used in formulated oils, resulting in an amount in total in the range 0 to 20 wt %.

In copending U.S. application Ser. No. 169,651, filed Oct. 9, 1998, it is taught that a lube oil of enhanced oxidation stability can be obtained when using a carbodimide acid scavenger in a base oil by employing a specific anti oxidant of the N-phenyl-1-naphthylamine type.

Amine anti-oxidant used in that invention is N-phenyl-naphthylamine or substituted derivative thereof, preferably N-phenyl-1-naphthylamine or substituted derivative of N-phenyl-1-naphthylamine generally of the formula

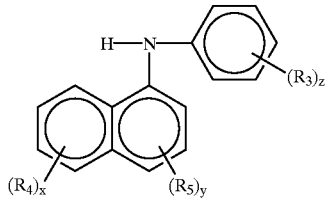

wherein $R_3$, $R_4$ and $R_5$ are the same or different and are hydrogen or $C_1$–$C_{12}$ hydrocarbyl group, or $C_1$–$C_{12}$ hydrocarbyl group containing O, N or S heteroatom or heteratom moiety containing group preferably selected from the group consisting of carboxyl, hydroxy, carbonyl ether, ester, thioether, amine where the heteroatom moiety containing group is substituted onto the $C_1$–$C_{12}$ hydrocarbyl backbone or the heteroatom constitutes part of the hydrocarbyl backbone, and each x, y and z are the same or different and are 1 to up to the unsatisfied valence of the respective phenyl and naphthyl moiety, preferably 1 to 3, and wherein when x, y or z are each 2 or greater, each $R_3$, $R_4$ or $R_5$ are the same or different and are as stated above. It is preferred that $R_3$ is H or $C_1$–$C_{12}$ hydro-carbyl most preferably $C_8$, and $R_4$ and $R_5$ are H, and x, y and z are each 1.

It has been found that combination of other acid scavengers with the above described N-phenyl-naphthylamine or substituted derivative of phenyl naphthyl amine and similarly combinations of different diaryl amines anti-oxidant with carbodiimide acid scavengers do not result in the synergistic improvement in resistance to oxidation as is evidenced by the combination of carbodiimide and N-phenyl-naphthylamine or substituted derivative of N-phenyl-naphthylamine.

Thus, if one desires to produce a formulated lube oil exhibiting both enhanced oxidation stability and anti rust performance the formulation would contain the recited N-phenyl-naphthylamine type anti oxidant, a carbo diimide acid scavenger and an acidic anti rust additive, wherein the acid scavenger and the acidic anti rust additives are included into the formulation using the sequential addition procedure recited herein.

The invention is further described by reference of the following comparative examples and non-limiting examples.

EXAMPLES

In the following runs, the rust data was collected using the ASTM D665B test described previously. Five (5) different formulations were evaluated. In all instances, except where noted, the base test formulation was the following:

| Component | Purpose | Percentage by Weight |
|---|---|---|
| Polyolester | Basestock | (~) 95 |
| PAO 2 | Basestock | 4.00 |

* described in U.S. Pat No. 5,681,800, U.S. Pat. No. 5,767,046 and U.S. Pat. No. 5,658,863. The polyol ester is a Neopolyol ester of tech penta erythritol (mixture of mono-, di- and tri-pentaerythritol) esterified with a mixture of predominantly linear $C_6$-$C_{12}$ acids and branched $C_8$ acid.

and an additive package containing anti wear, anti wear/EP, anti oxidant, copper passivator/copper passivator-EP, and antifoamant agents in a total amount of about 3 wt %.

To this base formulation was added various anti rust additives (about 0.05 wt %) and carbodimide acid scavengers (about 0.20 wt %) in different sequences.

Formulation 1 is a lube oil containing $HITEC_{536}$ anti rust additive in combination with ADDITIN $RC_{8500,}$ a carbodiimide acid scavenger. In the preparation of this formulation, all of the components were added to the base oil at a bulk oil temperature of about 65° C. with no consideration for the order of addition. The formulation failed the rust test.

Formulation 2 is a lube oil which is compositionally substantially similar to Formulation 1 but prepared using a different blending procedure. In Formulation 2 the acid scavenger was added last, after the addition of the acidic rust inhibitor and the other components and after the bulk oil temperature had decreased to 50° C. (down from 65° C.). This formulation also failed the rust test.

Formulation 3, an example of the present invention, is a lube oil of the same overall composition as Formulation 2, but made by the procedure wherein after the direct heating of the oil is ceased (following addition of all the additives other than the acidic anti rust additive and the acid scavenger), the oil is permitted to cool to a bulk oil temperature of about 50° C. the acid scavenger is added to the formulation. Thereafter the acidic rust inhibitor is added to the formulation with no additional direct heating. Formulation 3 passes the rust test.

Formulations 4 and 5 employ non acidic rust inhibitors and the aforesaid acid scavenger, added to the base formulation using the same procedure as used for Formulation 3. Neither of Formulation 4 or 5 passed the rust test.

The results are summarized in Table 1.

TABLE 1

| Formulation | Rust Inhibitor | ADDITIN RC 8500 Added (@ 50° C.) | Rust Inhibitor Last (after ADDITIN RC 8500) | ASTM D665B Rust Test |
|---|---|---|---|---|
| 1* | HITEC 536 | No | No | Fail (Moderate) |
| 2 | HITEC 536 | Yes | No | Fail (Moderate) |
| 3 | HITEC 536 | Yes | Yes | Pass |
| 4 | ADDITIN RC 4220 | Yes | Yes | Fail (Moderate) |
| 5 | NA-SUL EDS | Yes | Yes | Fail (Severe) |

*This sample differs slightly from the other samples shown in Table 1 in that it contains no anti foamant.

Note:

Fail (Light) is < 6 rust spots

Fail (Moderate) is > 6 rust spots

Fail (Severe) is > 5% of pin surface rusted

HITEC 536 is

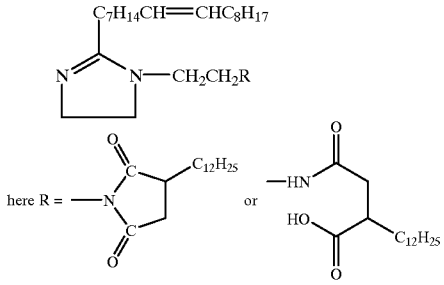

ADDITIN RC 8500 is

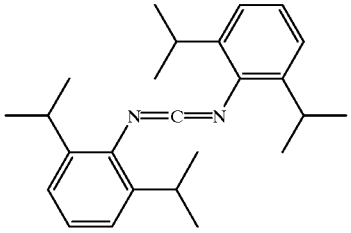

ADDITIN RC 4220 is

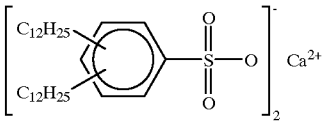

NASUL EDS is

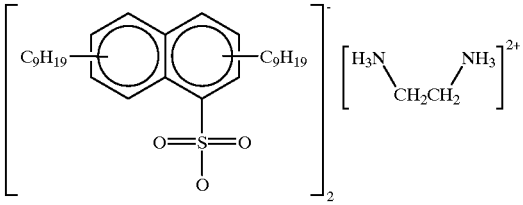

What is claimed is:

1. A method for producing lubricating oils possessing anti-rust properties containing acidic anti-rust additives and acid scavengers by adding the acid scavengers to the lubricating oil before the acidic anti-rust additive is added to the lubricating oil and insuring that the resulting mixture of lubricating oil, acid scavenger and acidic anti-rust additive is not subjected to direct heating, wherein the acid scavenger is selected from the group consisting of carbodiimides, glycidyl ethers, epoxides, alkanolamines, alkoxylated tertiaryamines, arylamines, and N,N,N',N' tetraalkyl 1,8 naphthylene diamine and wherein when carbodiimide is used as the acid scavenger the amount of carbodiimide employed is in the range of about 0.01 to 5 wt %, and wherein when epoxides or glycidyl ethers is used as the acid scavenger the amount of epoxides or glycidyl ethers employed is in the range of about 0.1 to 25 wt %, and wherein the amount of acidic anti-rust additive used is in the range of about 0.01 to 2 wt %.

2. The method of claim 1 wherein any other additives which are intended for use in the lubricating oil are added prior to the addition of the acid scavenger and acidic anti-rust additive, such other addition being added to the oil with any necessary direct heating being employed to effect their solubility in the oil, followed by cessation of direct heating prior to the sequential addition of the acid scavenger and acidic anti-rust additive.

3. The method of claim 2 wherein following the addition of the other additives and prior to the sequential addition of the acid scavenger and acidic anti-rust additive the mixture of oil and other additives is cooled or held at a bulk oil temperature of about 15–100° C. without any additional direct heating.

4. The method of claim 1, 2 or 3 wherein the acidic anti-rust additives are selected from the group consisting of carboxylic acids, carboxylic acid producing compounds, carbamic acids, carbamic acid producing compounds, oxo acids and salts of oxo acids of sulfur or phosphorus or compounds which produce such oxo acids.

* * * * *